US011952881B2

(12) United States Patent
Close et al.

(10) Patent No.: US 11,952,881 B2
(45) Date of Patent: Apr. 9, 2024

(54) METHOD FOR DRILLING WITH PROJECTIONS BASED ON ADJUSTED KALMAN FILTERS

(71) Applicant: NORALIS LIMITED, Glos (GB)

(72) Inventors: David Close, Austin, TX (US); George W. Troy, Loomis, CA (US)

(73) Assignee: Noralis Limited, Cheltenham (GB)

( * ) Notice: Subject to any disclaimer, the term of this patent is extended or adjusted under 35 U.S.C. 154(b) by 0 days.

(21) Appl. No.: 17/552,131

(22) Filed: Dec. 15, 2021

(65) Prior Publication Data

US 2023/0184078 A1 Jun. 15, 2023

(51) Int. Cl.
*E21B 44/00* (2006.01)
*E21B 7/04* (2006.01)
(Continued)

(52) U.S. Cl.
CPC ..... *E21B 44/00* (2013.01); *E21B 7/04* (2013.01); *E21B 45/00* (2013.01);
(Continued)

(58) Field of Classification Search
CPC . E21B 44/00; E21B 7/04; E21B 45/00; E21B 47/0025; E21B 47/013; E21B 47/0224; E21B 47/0228; E21B 2200/22
See application file for complete search history.

(56) References Cited

U.S. PATENT DOCUMENTS 4,545,242 A * 10/1985 Chan ..... E21B 47/04 73/152.01
5,551,286 A 9/1996 Booer
(Continued)

FOREIGN PATENT DOCUMENTS

CA 2509704 C * 5/2011 ..... E21B 44/00
WO 2006106337 A1 10/2016
WO 2018226233 A1 12/2018

OTHER PUBLICATIONS

A. V. Vlasenko and et al, "Investigation of prospects for forecasting non-linear time series by example of drilling oil and gas wells", IOP Conf. Series: Journal of Physics: Conf. Series 1015 (2018) 052036 (Year: 2018).*

(Continued)

*Primary Examiner* — Douglas Kay
(74) *Attorney, Agent, or Firm* — Craft Chu PLLC; Andrew W. Chu

(57) ABSTRACT

The method for drilling includes extending a borehole from a surface location to a borehole end with a drill string having a bottom hole assembly with a drill bit. A surface sensor and a downhole sensor take measurements used to project borehole features, like the borehole end. The measurements are used to project the borehole end so that the drill bit can be steered through the rock formation. The downhole sensor is separated from the bit location by a plurality of segments. The method includes corrections when the measurements at the downhole location are not the measurements at the bit location. As the drill bit travels, the types of corrections change, including applying an initial Kalman filter, a first adjusted Kalman filter, a second adjusted Kalman filter, and a third adjusted Kalman filter, according to the plurality of segments between the downhole sensor and the bit location.

16 Claims, 3 Drawing Sheets

(51) Int. Cl.

| | |
|---|---|
| ***E21B 45/00*** | (2006.01) |
| ***E21B 47/002*** | (2012.01) |
| ***E21B 47/013*** | (2012.01) |
| ***E21B 47/0224*** | (2012.01) |
| ***E21B 47/0228*** | (2012.01) |

(52) U.S. Cl.
CPC ..... *E21B 47/0025* (2020.05); *E21B 47/013* (2020.05); *E21B 47/0224* (2020.05); *E21B 47/0228* (2020.05); *E21B 2200/22* (2020.05)

(56) References Cited

U.S. PATENT DOCUMENTS 6,438,495 B1 * 8/2002 Chau ..... E21B 47/022 702/9
8,977,523 B2 3/2015 Ertas et al.
9,022,140 B2 5/2015 Marx et al.
2009/0314546 A1 * 12/2009 Mintchev ..... E21B 7/04 175/45
2013/0161096 A1 * 6/2013 Benson ..... E21B 44/00 175/26
2014/0121971 A1 * 5/2014 Hanak ..... E21B 47/0228 702/6
2015/0233229 A1 * 8/2015 Benson ..... E21B 47/10 700/275
2019/0257176 A1 * 8/2019 Dykstra ..... E21B 19/00
2019/0353023 A1 * 11/2019 Whitacre ..... E21B 7/06
2020/0040808 A1 12/2020 Gu et al.
2021/0019582 A1 1/2021 Ghadyali et al.

OTHER PUBLICATIONS

L. Wang and et al, "Vibration Error Correction for the FOGs-Based Measurement in a Drilling System Using an Extended Kalman Filter", Appl. Sci. 2021, 11, 6514, Published: Jul. 15, 2021 (Year: 2021).*

* cited by examiner

METHOD FOR DRILLING WITH PROJECTIONS BASED ON ADJUSTED KALMAN FILTERS

CROSS-REFERENCE TO RELATED APPLICATIONS

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to determining the position and orientation of the borehole based on the position of a drill bit. In particular, the present invention relates to making an improved Projection to Bit (PTB) projection from sensors while drilling. Even more particularly, the present invention relates to correcting the borehole projections, when the downhole sensors are separated from the drill bit by a length corresponding to a plurality of segments.

2. Description of Related Art Including Information Disclosed Under 37 CFR 1.97 and 37 CFR 1.98

To discover and produce hydrocarbons, such as oil and gas, a borehole is drilled through a geological formation deep in the earth. Such boreholes are formed by drill string comprised of a drill bit connected to sections of long pipe or drill pipe. The drill string extends from the earth surface to the bottom of the borehole. The drill bit is rotated so that the drill string advances through the geological formation, thereby forming the borehole. The drill bit can be rotated by rotating the drill string from the surface in rotary drilling. The drill bit itself can be rotated by a downhole mud motor coupled to the drill bit in directional drilling. The mud motor is bent at a slight angle to the centerline of the drill bit so as to create a side force that directs the path of the drill bit away from a straight line for steered directional drilling. In directional drilling, the drill pipe is rotated slowly so as to avoid being stuck to the formation. The drill pipe is not the main source of the drill bit rotation in steered directional drilling. The drill bit is lubricated, and cuttings from the formation are flushed from the borehole by drilling fluid or drilling mud pumped from the surface at high pressure. The drilling fluid mud can flow through an internal passage in the drill string and out through the drill bit. The drilling mud then flows to the surface through the annular passage formed between the drill string and the cut formation borehole.

Steering the drill bit requires data to determine position, orientation, and speed, similar to piloting aircraft or charting a course for a marine vessel. Collected data is used to generate estimates and projections for the drill bit to navigate through and around the geological formations. Weight on Bit (WOB), Mud Pump Pressure, Rate of Penetration (ROP), Gravity Toolface (GTF), Inclination (INC) and Azimuth (AZI) and other traditional oil field measurements, like depth, temperature and pressure, are used to determine Projection to Bit (PTB), True Vertical Depth (TVD) and other estimates of the borehole. The PTB is particularly relevant for the position and orientation of the borehole end when the drill bit is at the bottom of the borehole. Improving the PTB, while drilling, allows steering with accuracy and precision.

It is known that making a projection or estimate from just one measurement is less reliable than making a projection or estimate by integrating several measurements at the same time. A Kalman Filter is a known conventional and efficient way to combine a set of measurements that all occur at the same time in order to generate a projection.

Various prior art references are available in the oil and gas field for the making an estimated based on sets of data and correcting the estimates. U.S. Pat. No. 5,551,286, issued on 3 Sep. 1996 to Booer, WIPO Publication No. WO2018226233, published on 13 Dec. 2018 for Wilson et al., and U.S. Patent Publication No. 2021/0195828 21 Jan. 2021 Ghadyali et al. disclose correction of models based on data captured at different times, including use of a Kalman filter. There are also specific improvements of correcting projections in the oil and gas industry, including U.S. Pat. No. 454,524, issued on 8 Oct. 1985 to Chan, U.S. Pat. No. 8,977,523, issued on 10 Mar. 2015 to Ertas et al., U.S. Pat. No. 9,022,140, issued on 5 May 2015 to Marx et al., U.S. Patent Publication No. 2020/0408084, published on 31 Dec. 2020 for Gu et al., and WIPO Publication No. WO2006/106337, published on 12 Oct. 2016 for Eidsvik et al.

FIG. 1 shows a method using a Kalman filter. With the drill bit at an initial location K, a surface sensor 30 at a surface location 12 measures a respective parameter, such as depth, and a downhole sensor 32 at a downhole location 34 measures a respective parameter, such as inclination. The measurements of these respective parameters are used to project a feature of the borehole, such as Projection to Bit (PTB) for the borehole end, when the drill bit is at the bottom of the borehole. The conventional Kalman filter is a type of correction of the measurements based on reliability of data from each of the surface sensor and the downhole sensor. The correction can be adjustment of the collected or raw measurement to a measurement for calculations, a weighted scale of one measurement over another measurement, or other modification of the raw measurement from the respective sensor. Instead of relying on the accuracy of one sensor, the Kalman filter can accounts for the accuracies of all sensors, including the surface sensor, the downhole sensor, and other sensors, to improve projecting from the measurements. There is this first level of correction of raw measurements to account for inherent accuracy of sensor components and features of the sensors.

The modification of the Kalman filter by historical or past measurements is also known in the prior art. For example, if the PTB at initial location K in FIG. 1 projects the depth, when the drill bit moves a certain distance, then there is an efficacy check, when the drill bit actually reaches that certain distance. The measured depth at the certain distance can be compared to the projected depth, when the drill bit was only at the initial location K. The Kalman filter, that corrects raw measurements, can now be corrected itself. The error correction, such as adjusting raw measurements for calculations or a weighted scale, can now be modified to further improve the projection of the borehole features. There is this second level of correction based on the historical accuracy of Kalman filter to generate the projected parameter from the measurement at the initial location.

The problem is that there are gaps when the downhole sensor is separated from the drill bit. The drill bit is a dynamic tool with many moving components and physical interactions with the rock formation in different directions and angles. The downhole sensors are placed elsewhere on the bottom hole assembly (BHA) away from the high risk of damage and relative volatility of the drill bit. The real-life separation on a drill string can be 50 ft between the drill bit and a downhole sensor on the bottom hole assembly. There can be a gap of traveling 50 ft before any modification of the Kalman filter. Steering is constant, not every 50 ft. There is a need for the modification of the Kalman filter for more accuracy, even when the drill bit moves the distance between this gap. There can also be gaps in time because not all sensors are constantly streaming measurements as data. Some sensors may take time to reset after taking a measurement, and the drill bit will have moved a distance to a new location during that time. Other time delays may include transmission times for the measurement data to be received from the downhole location. Again, the drill bit will have moved a distance to another new location during that transmission time. The gaps in time correspond to distances traveled without measurements, which become similar to the missing distances caused by the separation gap between the drill bit and downhole sensor. The known modifications of the Kalman filter in the prior art cannot account for these gaps. It is not always possible to be so selective with using only particular historical data to make corrections. There is a need for a method of using a wider range of historical data to make corrections to the correcting Kalman filter.

It is an object of the present invention to provide a method for drilling based on projections of borehole features.

It is an object of the present invention to provide a method for drilling including the step of extending a borehole according to a projection of a borehole end using a Kalman filter.

It is an object of the present invention to provide a method for drilling including the step of extending a borehole according to a projection based on measurements from a surface sensor and a downhole sensor modified by a Kalman filter.

It is another object of the present invention to provide a method for drilling including the step of extending a borehole according to a projection based on measurements from a surface sensor and a downhole sensor, the downhole sensor being at a downhole location separated from a bit location of the drill bit.

It is still another object of the present invention to provide a method for drilling including the step of extending a borehole according to a projection based on measurements from a surface sensor and a downhole sensor, the downhole sensor being at a downhole location separated by a plurality of segments from a bit location of the drill bit.

It is yet another object of the present invention to provide a method for drilling including the step of extending a borehole according to a projection based on measurements from a surface sensor and a downhole sensor, the downhole sensor being at a downhole location separated from a bit location of the drill bit by a length divided by a plurality of segments.

These and other objectives and advantages of the present invention will become apparent from a reading of the attached specification.

BRIEF SUMMARY OF THE INVENTION

Embodiments of the present invention include the method for drilling by extending a borehole from a surface location to a borehole end with a drill string having a bottom hole assembly with a drill bit. Surface sensors and downhole sensors take measurements used to project borehole features. At least one surface sensor and at least one downhole sensor can take measurements to project the borehole end so that the drill bit can be steered through the rock or geological formation. In the present invention, the downhole sensor is separated from the bit location by a plurality of segments. The separation between the downhole location and the bit location is a distance that corresponds to the plurality of segments. The plurality has a plurality length S, and each segment has a respective segment length s. Each segment length s is always less than the plurality length S. There is a gap because the measurements at the downhole location are not the measurements at the bit location.

The method of the present invention includes corrections when the measurements at the downhole location are not the measurements at the bit location. As the drill bit travels, the types of corrections change. In the present invention, the drill bit at the initial location (K) can apply an initial Kalman filter based on the features of the sensors themselves. The measurements are corrected at this initial level for better projection of borehole features, but there is no historical data or measurements yet. As the drill bit moves from the initial location (K), the initial Kalman filter can be adjusted as past or historical measurements become available. The method of the present invention includes applying a first adjusted Kalman filter, a second adjusted Kalman filter, and a third adjusted Kalman filter to change the level of correction, according to the plurality of segments between the downhole sensor and the bit location or other gap. The method further includes repeating the steps for completing a wellbore.

In one embodiment, the plurality of segments is a first segment with a first segment length and a second segment with a second segment length. The plurality of segments still has a plurality length S. The invention includes more than two segments in the plurality of segments. The present invention is a method to account for the complications based on gaps, like the physical separation of the downhole sensors from the bit location. There can be further adjustment of the Kalman filter at different levels relative to the downhole sensor being at a downhole location separated by a plurality of segments from a bit location of the drill bit. The further adjustment is no longer limited to the plurality length between the downhole sensor and bit location.

DETAILED DESCRIPTION OF THE INVENTION

Figure 1:
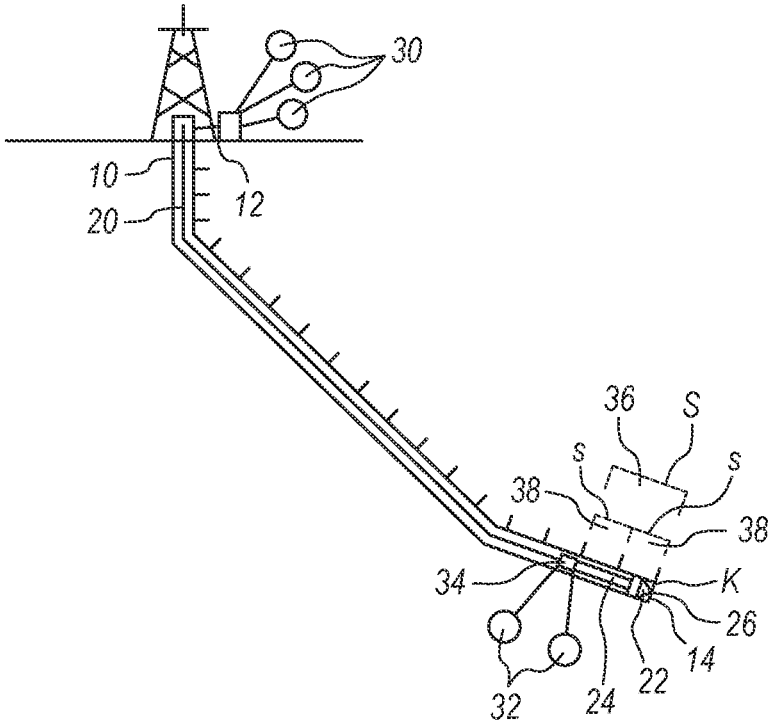
FIG. 1 is a schematic view of the method for drilling according to the present invention, showing the drill bit with the bit location at location (K).
Figure 2:
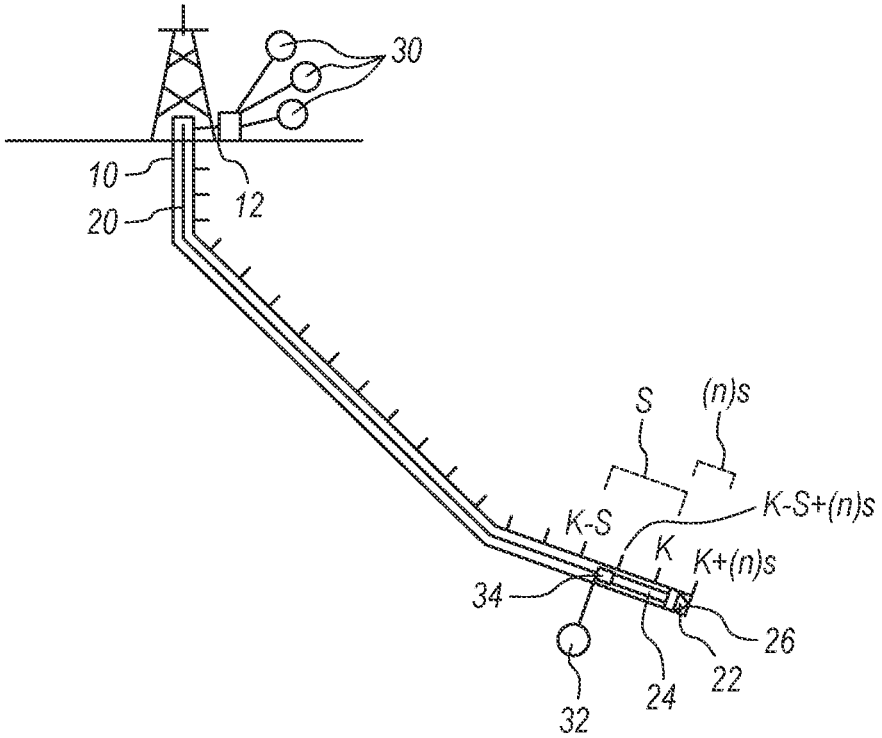
FIG. 2 is a schematic view of the method for drilling according to the present invention, showing the drill bit with the bit location at location (K+(n)s).
Figure 3:
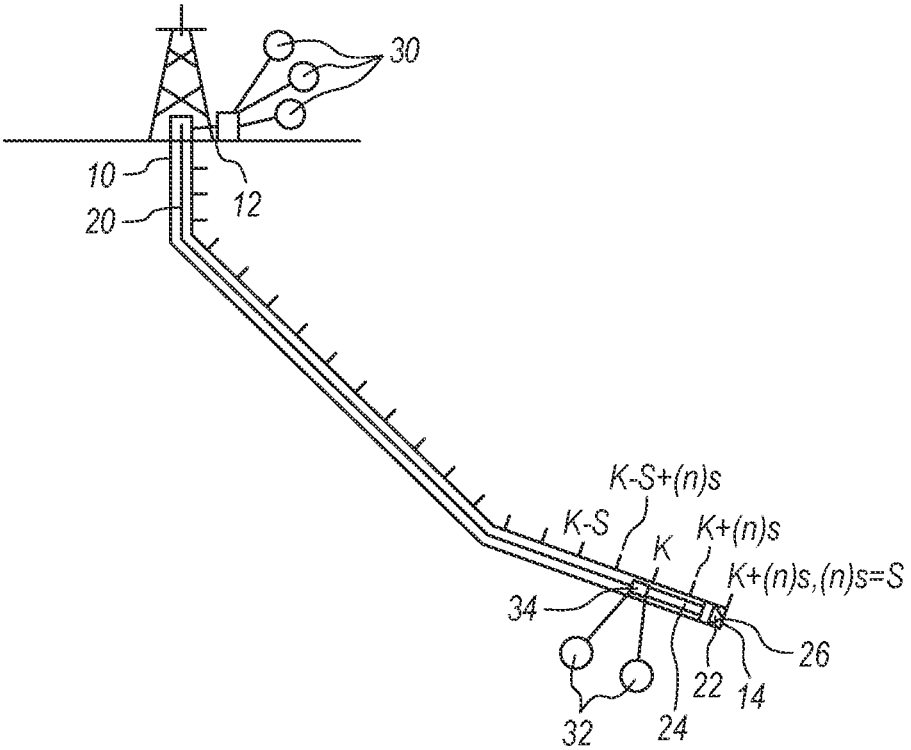
FIG. 3 is a schematic view of the method for drilling according to the present invention, showing the drill bit with the bit location at location (K+(n)s), when (n)s is equal to S.
Figure 4:
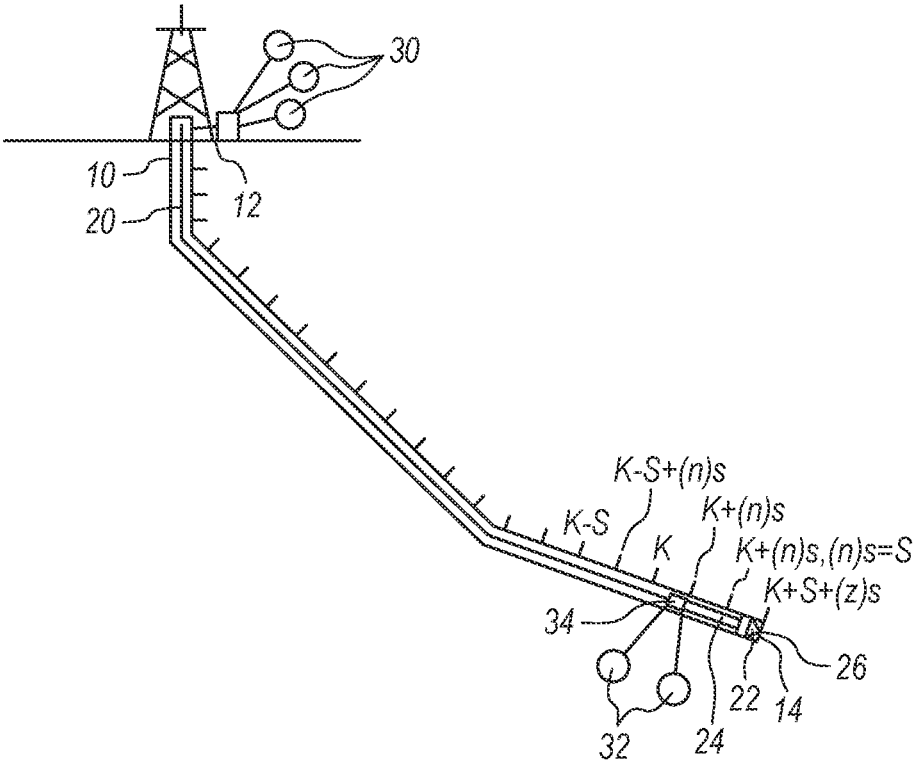
FIG. 4 is a schematic view of the method for drilling according to the present invention, showing the drill bit with the bit location at location (K+S+(z)s).
Figure 5:
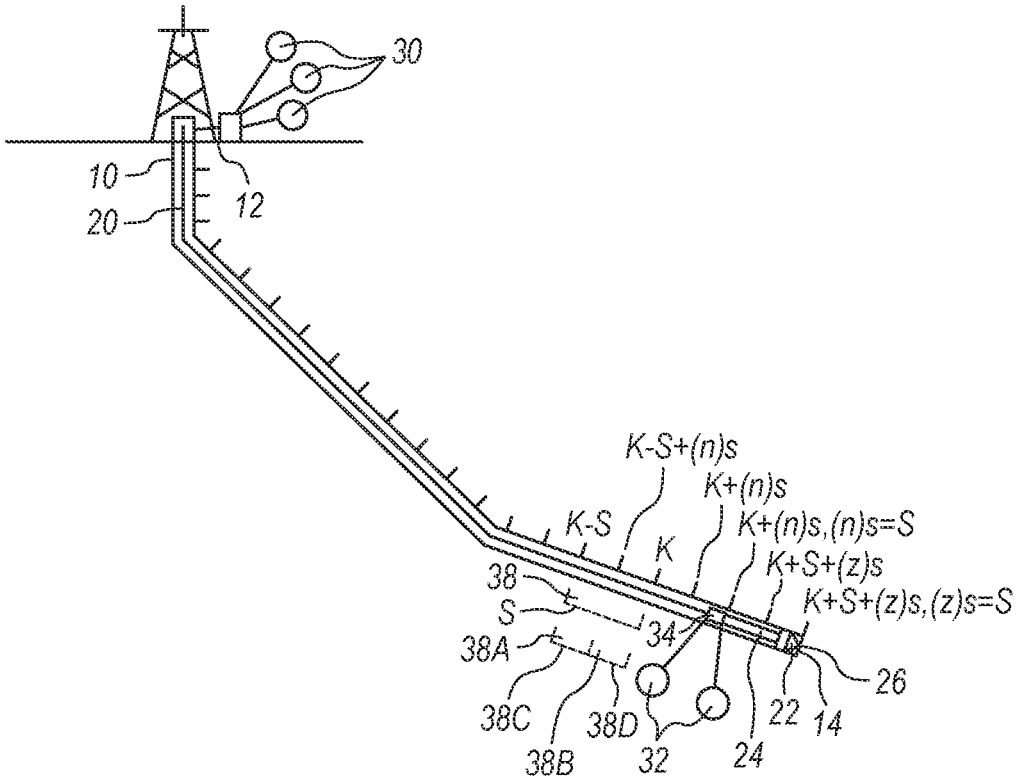
FIG. 5 is a schematic view of the method for drilling according to the present invention, showing the drill bit with the bit location at location (K+S+(z)s), when (z)s is equal to S.

Referring to FIG. 1-5, the present invention includes a borehole 10 extending from a surface location 12 to a borehole end 14 with a drill string 20 being comprised of a bottom hole assembly 24 with a drill bit 22. The bottom hole assembly 24 has a proximal end toward the surface location 12 and a distal end toward the borehole end 14. The drill bit 22 at the distal end of the bottom hole assembly 24 moves further into the rock formation as guided by projections to reach certain depths and inclinations as need to target hydrocarbons for discovery and production. The bottom hole assembly 24 can further include additional tool body sections between the proximal end and the drill bit 22 for logging, other sensors for additional measurements, and other components to actuate the drill bit. Other downhole tools on the drill string 20, such as reamers and stabilizers may also include sensors that may be compatible with the present invention. The downhole location of the downhole sensor can be on other tools, like logging tools, instead of the bottom hole assembly 24. Notably, the drill bit 22 in the bottom of the borehole sets the bit location 26 at or near the borehole end.

The surface location 12 is comprised of a surface sensor 30. The bottom hole assembly 24 is comprised of a downhole sensor 32 at a downhole location 34. The bit location 26 is separate from the downhole location 34. The drill bit 22 is at the distal end of the bottom hole assembly 24 and at the bit location 26, and the downhole sensor 32 is placed between the drill bit 22 and the proximal end of the bottom hole assembly 24. The downhole sensor 32 is away from the distal end of the bottom hole assembly 24 and at the downhole location 34. The downhole sensor 32 may also be on another downhole tool so that the downhole location 34 is not on the bottom hole assembly 24, but there is still the equivalent separation between the downhole location 34 and the bit location 26. The downhole sensor 32 is separated from the bit location 26 by a plurality 36 of segments 38. Thus, the separation between the downhole location 34 and the bit location 24 is a distance that corresponds to the plurality 36 of segments 36. The plurality 36 has a plurality length S, and each segment 38 has a respective segment length s. Each segment length s is always less than the plurality length S.

In some embodiments, the plurality length S is equally divided by the segments 38. The segment lengths s between the bit location 26 and the downhole location 34 are equal. Each segment length s is the same or equal to any segment length s for the plurality length S. Other embodiments include unequal segment lengths s for the plurality length S. The segments 38 are not required to be equal for the entire plurality 36 of segments 38. Embodiments also include each segment length s being an amount of length determined by a distance traveled by said drill bit for a predetermined time interval. In this example, the time interval may be the time needed to reset a sensor. If sensors are not streaming data, the drill bit is still moving, and a gap is created. The present invention still allows the advanced modification of the Kalman filter, even when the drill bit has traveled a gap based on distance or distance based on a time interval.

In the present invention, the surface sensor 30 is any sensor located at the surface location 12. There can also be a plurality of surface sensors with their respective surface sensor measurements, and each surface sensor measurement can be used to modify the Kalman filter according to the present invention. Additional surface sensors can be cumulative to further improve the accuracy of the projections. The surface sensor 30 can be a sensor for Rate of Penetration (ROP), sensor for Weight On Bit (WOP), sensor for Differential Pressure across the Drill Bit (DIFP), a depth sensor, a second for Rotary Speed of the Drill Pipe (RPM), or other sensor for measuring borehole and drill string features. A plurality of surface sensors can be a mix of these various sensors, but each of the plurality of surface sensors must still be determining surface sensor measurements at the surface location 12 for the bit location 26.

In the present invention, the downhole sensor 32 is any sensor located at the downhole location 34. There can also be a plurality of downhole sensors with their respective downhole sensor measurements, and each downhole sensor measurement can be used to modify the Kalman filter according to the present invention. Additional downhole sensors can be cumulative to further improve the accuracy of the projections. The downhole sensor 32 can be a sensor for Gravity Toolface (GTF), a pressure sensor, a temperature sensor, a sensor for Inclination (INC), a sensor for Azimuth (AZI), or other sensor for measuring borehole and drill string features. A plurality of downhole sensors can be a mix of these various sensors, but each of the plurality of downhole sensors must still be determining downhole sensor measurements at the downhole location 34 for the bit location 26.

As shown in FIGS. 1-5, the method of the present invention includes extending the borehole 10 from the surface location 12 to the borehole end 14. The step of extending is comprised of the following steps:

Step A: setting the drill bit at an initial location (K). The bit location 26 is at the initial location K, and the downhole location is at a K−S location.

Step B: measuring with the surface sensor at the surface location for the bit location 26 at the initial location (K) so as to determine an initial location (K) surface sensor measurement.

Step C: measuring with the downhole sensor at the downhole location for the bit location 26 at the initial location (K) so as to determine a location (K−S) downhole sensor measurement.

Step D: applying an initial Kalman filter to the initial location (K) surface sensor measurement and the location (K−S) downhole sensor measurement, so as to generate a projection of the borehole end for steering the drill bit. The initial Kalman filter is comprised of an initial error correction based on the initial location (K) surface sensor measurement and the location (K−S) downhole sensor measurement. This level of correction by the initial Kalman filter is based on the properties of the sensors themselves. There is no historical data yet, and there is no basis for further modification of the initial Kalman filter yet.

Step E: moving the drill bit to a location (K+(n)s). The bit location 26 is at the location (K+(n)s), and the downhole location is at a (K−S+(n)s) location. "n" is a positive integer, and "s" is a segment length. The drill bit 22 has moved less than the plurality length S, and the location (K−S) downhole sensor measurement has not additional use yet.

Step F: measuring with the surface location sensor at the surface location for the bit location 26 at the location (K+(n)s) so as to determine a location (K+(n)s) surface sensor measurement.

Step G: measuring with the downhole sensor at the downhole location for the bit location 26 at the location (K+(n)s) so as to determine a location (K−S+(n)s) downhole sensor measurement.

Step H: applying a first adjusted Kalman filter to the location (K+(n)s) surface sensor measurement and the location (K−S+(n)s) downhole sensor measurement, so as to generate a first adjusted projection of the borehole end for steering the drill bit. The first level adjusted Kalman filter is comprised of a first level adjusted error correction based on the initial location (K) surface sensor measurement, the location (K+(n)s) surface sensor measurement, and the location (K−S) downhole sensor measurement. As the drill bit 22 travels through the gap (plurality length S corresponding to the plurality 36 of segments 38), the surface sensor measurements for the bit location 26 can be used to adjust the initial Kalman filter for increased accuracy and precision. The downhole sensor measurements are taken, even though such measurements within the gap are not yet useful for further modifying the Kalman filter.

Step I: repeating the Steps E-H until n(s) is equal to S. The drill bit 22 through the gap generates the first adjusted projections, and the location (K−S+(n)s) downhole sensor measurements are still taken and can be used for the first adjusted projections. However, the first level adjusted error correction is made without the location (K−S+(n)s) downhole sensor measurements.

Step J: moving the drill bit to the location (K+(n)s) when (K+(n)s) is equal to (K+S). The bit location 26 is at the location (K+(n)s), and the downhole location is at the (K−S+(n)s) location when (K−S+(n)s) is equal to (K). The drill bit 22 has moved the plurality length S, and the location (K−S) downhole sensor measurement can now be used to confirm the location (K−S+(n)s) downhole sensor measurement, which is now the location (K) downhole sensor measurement, since (n)s is equal to S at this location.

Step K: measuring with the surface location sensor at the surface location for the bit location 26 at the location (K+S) so as to determine a location (K+S) surface sensor measurement.

Step L: measuring with the downhole sensor at the downhole location for the bit location 26 at the location (K) so as to determine a location (K) downhole sensor measurement.

Step M: applying a second level adjusted Kalman filter to the location (K+S) surface sensor measurement and the location (K) downhole sensor measurement, so as to generate a second level adjusted projection of the borehole end for steering the drill bit. The second level adjusted Kalman filter is comprised of a second level adjusted error correction based on the initial location (K) surface sensor measurement, the location (K+(n)s) surface sensor measurement, the location (K+S) surface sensor measurement, the location (K−S) downhole sensor measurement and the location (K) downhole sensor measurement. The drill bit 22 has now traveled the gap (plurality length S corresponding to the plurality 36 of segments 38), and now both the surface sensor measurements for the bit location 26 and the downhole sensor measurements for the bit location 26 can be used to adjust the first level adjusted Kalman filter. The measurements previously unused due to the gap (separation between the downhole sensor 32 and bit location 26 or separation by a time interval) are now part of the method of the present invention. The downhole sensor measurements are not able to be used in the modification of the Kalman filter for a second level adjusted Kalman filter.

Step N: moving the drill bit to a location (K+S+(z)s). The bit location 26 is at the location (K+S+(z)s), and the downhole location is at the (K+(z)s) location. "z" is a positive integer, and "s" is still a segment length. The drill bit 22 has now moved more than the plurality length S, and the second level adjusted Kalman filter is based on the location (K) downhole sensor measurement. There is a now a location (K+(z)s) downhole sensor measurement, and the present invention includes a method to now use this location (K+(z)s) downhole sensor measurement, even though the drill bit 22 has traveled into the next gap. That is, the drill bit 22 traveled the plurality length S and has now moved an additional (z) segment lengths s. The drill bit 22 has not yet moved another plurality length S for another second level adjusted Kalman filter.

Step O: measuring with the surface location sensor at the surface location for the bit location 26 at the location (K+S+(z)s) so as to determine a location (K+S+(z)s) surface sensor measurement.

Step P: measuring with the downhole sensor at the downhole location for the bit location 26 at the location (K+(z)s) so as to determine a location (K+(z)s) downhole sensor measurement.

Step Q: applying a third level adjusted Kalman filter to the location (K+S+(z)s) surface sensor measurement and the location (K+(z)s) downhole sensor measurement, when z is equal to n, so as to generate a third level adjusted projection of the borehole end for steering the drill bit. The third level adjusted Kalman filter is comprised of a third level adjusted error correction based on the initial location (K) surface sensor measurement, the location (K+(n)s) surface sensor measurement, the location (K+S) surface sensor measurement, the location (K+S+(z)s) surface sensor measurement, the location (K−S) downhole sensor measurement, the location (K) downhole sensor measurement, the location (K−S+(n)s) downhole sensor measurement, and the location (K+(z)s) downhole sensor measurement. With the drill bit 22 moving beyond the plurality length S, the location (K−S+(n)s) downhole sensor measurement is now recited in the method for applying the third level adjusted Kalman filter. The third level adjusted error correction is now based on the location (K−S+(n)s) downhole sensor measurement. The location (K−S+(n)s) downhole sensor measurement was previously unusable for the modification of the Kalman filter, and the present invention now incorporates the location (K−S+(n)s) downhole sensor measurement for the third level adjusted Kalman filter. This third level adjusted projection of the borehole end has a correction beyond any of the prior art methods, when there is the plurality 36 of segments 38 between the downhole sensor 32 and the bit location 26. The gap of this separation allows the location (K−S+(n)s) downhole sensor measurement to be applied to the further modification of the Kalman filter, even when drill bit 32 has not traveled a full plurality length S. There is increased accuracy due to the additional modifications to the adjusted Kalman filter.

The method further includes repeating the Steps N-Q for completing a wellbore. Once the drill bit 22 has traveled past a plurality length S, Steps N-Q can be repeated for the third level adjusted projections to complete the borehole. The method further includes stopping and restarting so that the initial location can be reset. Again, there are different gaps or separations that can occur when drilling the borehole. Whether the drill bit 22 travels without data between certain distances for time, distance, communication delays, or other reasons, the present invention enables the measurements from the gaps to further modify the adjusted Kalman filters. The embodiments of the present invention include the plurality 36 of segments 38 being comprised of two segments, 38A, 38C. In most embodiments, there are more than two segments 38A, 38C.

In an exemplary embodiment of the plurality 36 of segments 38 being comprised of a first segment 38A with a first segment length 38B and a second segment 38C with a second segment length 38D, the plurality 36 of segments 38 still has a plurality length S. The downhole sensor 32 is still separated from the bit location 26 by the plurality 36 of segments 38. The first segment length 38B and the second segment lengths 38D can be equal. The first segment length 38B and the second segment lengths 38D can also be determined by a distance traveled by the drill bit 22 for a predetermined time interval.

This alternative embodiment includes the method for drilling, comprising the step of extending a borehole 10 from a surface location 12 to a borehole end 14 with a drill string 20 being comprised of a bottom hole assembly 24 with a drill bit 22. The step of extending includes:

Step A1: setting the drill bit at an initial location (K). The bit location 26 is at the initial location K, and the downhole location being at a K−S location.

Step B1: measuring with the surface sensor at the surface location for the bit location 26 at the initial location (K) so as to determine an initial location (K) surface sensor measurement.

Step C1: measuring with the downhole sensor at the downhole location for the bit location 26 at the initial location (K) so as to determine a location (K−S) downhole sensor measurement.

Step D1: applying an initial Kalman filter to the initial location (K) surface sensor measurement and the location (K−S) downhole sensor measurement, so as to generate a projection of the borehole end for steering the drill bit. The initial Kalman filter is comprised of an initial error correction based on the initial location (K) surface sensor measurement and the location (K−S) downhole sensor measurement. Again, the initial Kalman filter is based on the sensors themselves.

Step E1: moving the drill bit to a location (K+the first segment length). The bit location 26 is at the location (K+the first segment length), and the downhole location being at a (K−S+the first segment length) location.

Step F1: measuring with the surface location sensor at the surface location for the bit location 26 at the location (K+the first segment length) so as to determine a location (K+the first segment length) surface sensor measurement.

Step G1: measuring with the downhole sensor at the downhole location for the bit location 26 at the location (K+the first segment length) so as to determine a location (K−S+the first segment length) downhole sensor measurement.

Step H1: applying a first adjusted Kalman filter to the location (K+the first segment length) surface sensor measurement and the location (K−S+the first segment length) downhole sensor measurement, so as to generate a first adjusted projection of the borehole end for steering the drill bit. The first level adjusted Kalman filter is comprised of a first level adjusted error correction based on the initial location (K) surface sensor measurement, the location (K+the first segment length) surface sensor measurement, and the location (K−S) downhole sensor measurement. The location (K−S+the first segment length) downhole sensor measurement is not used to modify the initial Kalman filter into the first adjusted Kalman filter.

Step I1: moving the drill bit to the location (K+the first segment length+the second segment length) when (K+the first segment length+the second segment length) is equal to (K+S). The bit location 26 is at the location (K+the first segment length+the second segment length). The downhole location is at the (K) location because (K+the first segment length+the second segment length) is equal to (K+S). The drill bit 22 has now traveled the gap (the plurality length S).

Step J1: measuring with the surface location sensor at the surface location for the bit location 26 at the location (K+S) so as to determine a location (K+S) surface sensor measurement.

Step K1: measuring with the downhole sensor at the downhole location for the bit location 26 at the location (K) so as to determine a location (K) downhole sensor measurement.

Step L1: applying a second level adjusted Kalman filter to the location (K+S) surface sensor measurement and the location (K) downhole sensor measurement, so as to generate a second level adjusted projection of the borehole end for steering the drill bit. The second level adjusted Kalman filter is comprised of a second level adjusted error correction based on the initial location (K) surface sensor measurement, the location (K+the first segment length) surface sensor measurement, the location (K+S) surface sensor measurement, the location (K−S) downhole sensor measurement and the location (K) downhole sensor measurement. The location (K−S+the first segment length) downhole sensor measurement is still not used to modify the first adjusted Kalman filter into the second adjusted Kalman filter.

Step M1: moving the drill bit to a location (K+S+the first segment length). The bit location 26 is at the location (K+S+the first segment length), and the downhole location is at the (K+the first segment length) location.

Step N1: measuring with the surface location sensor at the surface location for the bit location 26 at the location (K+S+the first segment length) so as to determine a location (K+S+the first segment length) surface sensor measurement.

Step O1: measuring with the downhole sensor at the downhole location for the bit location 26 at the location (K+the first segment length) so as to determine a location (K+the first segment length) downhole sensor measurement.

Step P1: applying a third level adjusted Kalman filter to the location (K+S+the first segment length) surface sensor measurement and the location (K+the first segment length) downhole sensor measurement, so as to generate a third level adjusted projection of the borehole end for steering the drill bit. The third level adjusted Kalman filter is comprised of a third level adjusted error correction based on the initial location (K) surface sensor measurement, the location (K+the first segment length) surface sensor measurement, the location (K+S) surface sensor measurement, the location (K+S+the first segment length) surface sensor measurement, the location (K−S) downhole sensor measurement, the location (K) downhole sensor measurement, and the location (K+the first segment length) downhole sensor measurement. The location (K−S+the first segment length) downhole sensor measurement is finally used to modify the second adjusted Kalman filter into the third adjusted Kalman filter.

In this embodiment, the drill bit 22 reaches another plurality length S in only two segments. The method can further include:

Step M2: moving the drill bit to a location (K+S+the first segment length+the second segment length). The bit location 26 is at the location (K+S+the first segment length+the second segment length), and the downhole location is at the (K+S) location.

Step N2: measuring with the surface location sensor at the surface location for the bit location 26 at the location (K+S+the first segment length+the second segment length) so as to determine a location (K+S+the first segment length+the second segment length) surface sensor measurement.

Step O2: measuring with the downhole sensor at the downhole location for the bit location 26 at the location (K+the first segment length+the second segment length) so as to determine a location (K+S) downhole sensor measurement.

Step P2: applying another third level adjusted Kalman filter to the location (K+S+the first segment length+the second segment length) surface sensor measurement and the location (K+S) downhole sensor measurement, so as to generate another third level adjusted projection of the borehole end for steering the drill bit. The another third level adjusted Kalman filter is comprised of a third level adjusted error correction based on the initial location (K) surface sensor measurement, the location (K+the first segment length) surface sensor measurement, the location (K+S) surface sensor measurement, the location (K+S+the first segment length) surface sensor measurement, the location (K+S+the first segment length+the second segment length) surface sensor measurement, the location (K−S) downhole sensor measurement, the location (K) downhole sensor measurement, the location (K+the first segment length) downhole sensor measurement, and the location (K+S) downhole sensor measurement.

To complete the wellbore, this method further includes repeating Steps M1-P1 for moving the drill bit another first segment length and the Steps M2-P2 for moving the drill bit another second segment length.

The present invention provides a method for drilling based on measurements from at least one sensor at a surface location for a bit location measurement and at least one sensor at a downhole location separated from the drill bit by a plurality of segments and adjusted Kalman filters, according to the separation or gaps in measurements between the bit location and downhole location. The adjusted Kalman filters are applied to raw measurements for projections to steer a drill bit. The projection can be a Projection to Bit (PTB) for the bottom of the borehole. The borehole features, like depth, inclination, and diameter, are needed for determination of subsequent installations and interventions to produce oil and gas from the geological or rock formation. The production zones crossed and the angle of crossing the production zones are important information. While drilling, the drill bit should be steered so that the borehole features are as close as possible to the calculations and studies of the geological formation. A Kalman filter is helpful to increase accuracy of the projection based on multiple measurements, but the Kalman filter can also require modification so that the accuracy of the projection is even more improved.

In the present invention, there is a complication based on gaps. There is a practical separation of the downhole sensors from the bit location. This distance gap can be several feet, and waiting several feet, like 50 feet, to adjust a correction may not be sufficient for the active steering of a drill bit. Data is not always streaming either. There can be gaps in distance traveled by the drill bit caused by time intervals between taking measurements or transmitting measurements. There can be further adjustment of the Kalman filter at different levels relative to the downhole sensor being at a downhole location separated by a plurality of segments from a bit location of the drill bit. The further adjustment is no longer limited to the plurality length between the downhole sensor and bit location.

The foregoing disclosure and description of the invention is illustrative and explanatory thereof. Various changes in the details of the illustrated structures, construction and method can be made without departing from the true spirit of the invention.

We claim:

1. A method for drilling, comprising steps of:

extending a borehole from a surface location to a borehole end with a drill string being comprised of a bottom hole assembly with a drill bit, wherein the drill bit is positioned on the bottom hole assembly at said borehole end so as to set a bit location, wherein said surface location is comprised of a surface sensor, wherein said bottom hole assembly is comprised of a downhole sensor at a downhole location, wherein said downhole sensor is separated by a plurality of segments from said bit location, wherein said plurality of said segments has a length S, said bit location and said downhole locations being separated by said length S, wherein each segment has a segment length s less than said length, and wherein the step of extending is comprised of following steps:

Step A: setting said drill bit at an initial location (K) in the borehole, said bit location being at said initial location K, said downhole location being at a K−S location;

Step B: measuring with said surface sensor at said surface location for said bit location at said initial location (K) so as to determine an initial location (K) surface sensor measurement;

Step C: measuring with said downhole sensor at said downhole location for said bit location at said initial location (K) so as to determine a location (K−S) downhole sensor measurement;

Step D: applying an initial Kalman filter to said initial location (K) surface sensor measurement and said location (K−S) downhole sensor measurement, so as to generate a projection of said borehole end for steering said drill bit, wherein said initial Kalman filter is comprised of an initial error correction based on said initial location (K) surface sensor measurement and said location (K−S) downhole sensor measurement;

Step E: moving said drill bit to a location (K+(n)s) in the borehole according to the projection of Step D, said bit location being at said location (K+(n)s), said downhole location being at a (K−S+(n)s) location, wherein n is a positive integer;

Step F: measuring with said surface location sensor at said surface location for said bit location at said location (K+(n)s) so as to determine a location (K+(n)s) surface sensor measurement;

Step G: measuring with said downhole sensor at said downhole location for said bit location at said location (K+(n)s) so as to determine a location (K−S+(n)s) downhole sensor measurement;

Step H: applying a first level adjusted Kalman filter to said location (K+(n)s) surface sensor measurement and said location (K−S+(n)s) downhole sensor measurement, so as to generate a first level adjusted projection of said borehole end for steering said drill bit, wherein said first level adjusted Kalman filter is comprised of a first level adjusted error correction based on said initial location (K) surface sensor measurement, said location (K+(n)s) surface sensor measurement, and said location (K−S) downhole sensor measurement;

Step I: repeating the Steps E-H until (n)s is equal to S, wherein said projection of Step D is replaced with a corresponding first level adjusted projection of a respective Step H during a subsequent step of repeating Step E;

Step J: moving said drill bit to said location (K+(n)s) in the borehole according to the corresponding first level adjusted projection of the respective repeated Step H when (K+(n)s) is equal to (K+S), said bit location being at said location (K+(n)s), said downhole location being at said (K−S+(n)s) location when (K−S+(n)s) is equal to (K);

Step K: measuring with said surface location sensor at said surface location for said bit location at said location (K+S) so as to determine a location (K+S) surface sensor measurement;

Step L: measuring with said downhole sensor at said downhole location for said bit location at said location (K) so as to determine a location (K) downhole sensor measurement;

Step M: applying a second level adjusted Kalman filter to said location (K+S) surface sensor measurement and said location (K) downhole sensor measurement, so as to generate a second level adjusted projection of said borehole end for steering said drill bit, wherein said second level adjusted Kalman filter is comprised of a second level adjusted error correction based on said initial location (K) surface sensor measurement, said location (K+(n)s) surface sensor measurement, said location (K+S) surface sensor measurement, said location (K−S) downhole sensor measurement and said location (K) downhole sensor measurement;

Step N: moving said drill bit to a location (K+S+(z)s) in the borehole according to the second level adjusted projection of Step M, said bit location 26 being at said location (K+S+(z)s), said downhole location being at said (K+(z)s) location, wherein z is a positive integer;

Step O: measuring with said surface location sensor at said surface location for said bit location at said location (K+S+(z)s) so as to determine a location (K+S+(z)s) surface sensor measurement;

Step P: measuring with said downhole sensor at said downhole location for said bit location at said location (K+(z)s) so as to determine a location (K+(z)s) downhole sensor measurement;

Step Q: applying a third level adjusted Kalman filter to said location (K+S+(z)s) surface sensor measurement and said location (K+(z)s) downhole sensor measurement, when z is equal to n, so as to generate a third level adjusted projection of said borehole end for steering said drill bit, wherein said third level adjusted Kalman filter is comprised of a third level adjusted error correction based on said initial location (K) surface sensor measurement, said location (K+(n)s) surface sensor measurement, said location (K+S) surface sensor measurement, said location (K+S+(z)s) surface sensor measurement, said location (K−S) downhole sensor measurement, said location (K−S+(n)s) downhole sensor measurement, said location (K) downhole sensor measurement, and said location (K+(z)s) downhole sensor measurement;

repeating the Steps N-Q for completing the borehole, wherein the second level adjusted projection of Step M is replaced with a corresponding third adjusted projection of a respective Step Q during the step of repeating Step N.

2. The method for drilling, according to claim 1, wherein said length S is equally divided by said segments between said bit location and said downhole location.

3. The method for drilling, according to claim 2, wherein each segment length is equal to another segment length for said plurality of said segments.

4. The method for drilling, according to claim 1, wherein each segment length s is an amount of length determined by a distance traveled by said drill bit for a predetermined time interval.

5. The method for drilling, according to claim 1, wherein said surface sensor is comprised of at least one of a group consisting of: a sensor for Rate of Penetration (ROP), sensor for Weight On Bit (WOP), sensor for Differential Pressure across the Drill Bit (DIFP), a depth sensor, and a second for Rotary Speed of the Drill Pipe (RPM).

6. The method for drilling, according to claim 1, wherein said downhole sensor is comprised of at least one of a group consisting of: a sensor for Gravity Toolface (GTF), a pressure sensor, a temperature sensor, a sensor for Inclination (INC), and a sensor for Azimuth (AZI).

7. The method for drilling, according to claim 1, wherein said plurality of segments is comprised of two segments.

8. The method for drilling, according to claim 1, wherein said plurality of segments is comprised of more than two segments.

9. A method for drilling, comprising steps of:

extending a borehole from a surface location to a borehole end with a drill string being comprised of a bottom hole assembly with a drill bit, wherein the drill bit is positioned on the bottom hole assembly at said borehole end so as to set a bit location, wherein said surface location is comprised of a surface sensor at said surface location, wherein said bottom hole assembly is comprised of a downhole sensor at a downhole location, wherein said downhole sensor is separated by a plurality of segments from said bit location, wherein said plurality of said segments has a length S, said bit location and said downhole locations being separated by said length S, wherein each segment has a segment length s less than said length, wherein said plurality of segments is comprised of a first segment having a first segment length and a second segment having a second segment length, and wherein the step of extending is comprised of the following steps:

Step A1: setting said drill bit at an initial location (K), said bit location being at said initial location K, said downhole location being at a K−S location;

Step B1: measuring with said surface sensor at said surface location for said bit location at said initial location (K) so as to determine an initial location (K) surface sensor measurement;

Step C1: measuring with said downhole sensor at said downhole location for said bit location at said initial location (K) so as to determine a location (K−S) downhole sensor measurement;

Step D1: applying an initial Kalman filter to said initial location (K) surface sensor measurement and said location (K−S) downhole sensor measurement, so as to generate a projection of said borehole end for steering said drill bit, wherein said initial Kalman filter is comprised of an initial error correction based on said initial location (K) surface sensor measurement and said location (K−S) downhole sensor measurement;

Step E1: moving said drill bit to a location (K+said first segment length) in the borehole according to the projection of Step D1, said bit location being at said location (K+said first segment length), said downhole location being at a (K−S+said first segment length) location, Step F1: measuring with said surface location sensor at said surface location for said bit location at said location (K+said first segment length) so as to determine a location (K+said first segment length) surface sensor measurement;

Step G1: measuring with said downhole sensor at said downhole location for said bit location at said location (K+said first segment length) so as to determine a location (K−S+said first segment length) downhole sensor measurement;

Step H1: applying a first level adjusted Kalman filter to said location (K+said first segment length) surface sensor measurement and said location (K−S+said first segment length) downhole sensor measurement, so as to generate a first level adjusted projection of said borehole end for steering said drill bit, wherein said first level adjusted Kalman filter is comprised of a first level adjusted error correction based on said initial location (K) surface sensor measurement, said location (K+said first segment length) surface sensor measurement, and said location (K−S) downhole sensor measurement;

Step I1: moving said drill bit to said location (K+said first segment length+said second segment length) in the borehole according to the first adjusted projection of Step H1 when (K+said first segment length+said second segment length) is equal to (K+S), said bit location being at said location (K+said first segment length+said second segment length), said downhole location being at said (K) location when (K+said first segment length+said second segment length) is equal to (K+S);

Step J1: measuring with said surface location sensor at said surface location for said bit location at said location (K+S) so as to determine a location (K+S) surface sensor measurement;

Step K1: measuring with said downhole sensor at said downhole location for said bit location at said location (K) so as to determine a location (K) downhole sensor measurement;

Step L1: applying a second level adjusted Kalman filter to said location (K+S) surface sensor measurement and said location (K) downhole sensor measurement, so as to generate a second level adjusted projection of said borehole end for steering said drill bit, wherein said second level adjusted Kalman filter is comprised of a second level adjusted error correction based on said initial location (K) surface sensor measurement, said location (K+said first segment length) surface sensor measurement, said location (K+S) surface sensor measurement, said location (K−S) downhole sensor measurement and said location (K) downhole sensor measurement;

Step M1: moving said drill bit to a location (K+S+said first segment length) in the borehole according to the second level adjusted error correction of Step L1, said bit location 26 being at said location (K+S+said first segment length), said downhole location being at said (K+said first segment length) location, Step N1: measuring with said surface location sensor at said surface location for said bit location at said location (K+S+said first segment length) so as to determine a location (K+S+said first segment length) surface sensor measurement;

Step O1: measuring with said downhole sensor at said downhole location for said bit location at said location (K+said first segment length) so as to determine a location (K+said first segment length) downhole sensor measurement; and Step P1: applying a third level adjusted Kalman filter to said location (K+S+said first segment length) surface sensor measurement and said location (K+said first segment length) downhole sensor measurement, so as to generate a third level adjusted projection of said borehole end for steering said drill bit, wherein said third level adjusted Kalman filter is comprised of a third level adjusted error correction based on said initial location (K) surface sensor measurement, said location (K+said first segment length) surface sensor measurement, said location (K+S) surface sensor measurement, said location (K+S+said first segment length) surface sensor measurement, said location (K−S) downhole sensor measurement, said location (K) downhole sensor measurement, and said location (K+said first segment length) downhole sensor measurement.

10. The method for drilling, according to claim 9, further comprising the steps of:

Step M2: moving said drill bit to a location (K+S+said first segment length+said second segment length) in the borehole according to the second level adjusted error correction of Step L1, said bit location being at said location (K+S+said first segment length+said second segment length), said downhole location being at said (K+S) location, Step N2: measuring with said surface location sensor at said surface location for said bit location at said location (K+S+said first segment length+said second segment length) so as to determine a location (K+S+said first segment length+said second segment length) surface sensor measurement;

Step O2: measuring with said downhole sensor at said downhole location for said bit location at said location (K+said first segment length+said second segment length) so as to determine a location (K+S) downhole sensor measurement; and Step P2: applying another third level adjusted Kalman filter to said location (K+S+said first segment length+said second segment length) surface sensor measurement and said location (K+S) downhole sensor measurement, so as to generate another third level adjusted projection of said borehole end for steering said drill bit, wherein said another third level adjusted Kalman filter is comprised of a third level adjusted error correction based on said initial location (K) surface sensor measurement, said location (K+said first segment length)

surface sensor measurement, said location (K+S) surface sensor measurement, said location (K+S+said first segment length) surface sensor measurement, said location (K+S+said first segment length+said second segment length) surface sensor measurement, said location (K−S) downhole sensor measurement, said location (K) downhole sensor measurement, said location (K+said first segment length) downhole sensor measurement, and said location (K+S) downhole sensor measurement.

11. The method for drilling, according to claim 10, further comprising the steps of:

repeating the Steps M1-P1 for moving said drill bit another first segment length, wherein the second level adjusted projection of Step L1 is replaced with a corresponding third adjusted projection of a respective Step P1 during the step of repeating Step M1; and repeating the Steps M2-P2 for moving said drill bit another second segment length, wherein the second level adjusted projection of Step L1 is replaced with a corresponding third level adjusted projection of a respective Step P2 during the step of repeating Step M2 so as to complete a wellbore.

12. The method for drilling, according to claim 9, wherein said length S is equally divided by said segments 38 between said bit location and said downhole location.

13. The method for drilling, according to claim 12, wherein said first segment length is equal to said second segment length.

14. The method for drilling, according to claim 9, wherein each segment length s is an amount of length determined by a distance traveled by said drill bit for a predetermined time interval.

15. The method for drilling, according to claim 9, wherein said surface sensor is comprised of at least one of a group consisting of: a sensor for Rate of Penetration (ROP), sensor for Weight On Bit (WOP), sensor for Differential Pressure across the Drill Bit (DIFP), a depth sensor, and a second for Rotary Speed of the Drill Pipe (RPM).

16. The method for drilling, according to claim 9, wherein said downhole sensor is comprised of at least one of a group consisting of: a sensor for Gravity Toolface (GTF), a pressure sensor, a temperature sensor, a sensor for Inclination (INC), and a sensor for Azimuth (AZI).

* * * * *